US009980522B1

(12) United States Patent
Heidl et al.

(10) Patent No.: US 9,980,522 B1
(45) Date of Patent: May 29, 2018

(54) SELF-LOCKING CARTRIDGE

(71) Applicant: NATIONAL CONCESSIONS GROUP INC., Denver, CO (US)

(72) Inventors: Jeremy Heidl, Denver, CO (US); Andrew Rexroad, Denver, CO (US)

(73) Assignee: NATIONAL CONCESSIONS GROUP INC., Denver, CO (US)

( * ) Notice: Subject to any disclaimer, the term of this patent is extended or adjusted under 35 U.S.C. 154(b) by 0 days. days.

(21) Appl. No.: 15/395,335

(22) Filed: Dec. 30, 2016

(51) Int. Cl.
*A24F 47/00* (2006.01)

(52) U.S. Cl.
CPC ..... *A24F 47/008* (2013.01)

(58) Field of Classification Search
CPC ..... A24F 47/008; A24F 47/004; H01R 43/26; Y10T 29/49208
USPC ..... 131/328, 329, 273, 225
See application file for complete search history.

(56) References Cited

U.S. PATENT DOCUMENTS

| | | | | |
|---|---|---|---|---|
| 8,910,639 | B2 | 12/2014 | Chang et al. | |
| 2004/0129280 | A1* | 7/2004 | Woodson | A24B 15/282 131/194 |
| 2009/0095311 | A1* | 4/2009 | Han | A24F 47/008 131/194 |
| 2010/0307518 | A1* | 12/2010 | Wang | A24F 47/008 131/329 |
| 2016/0120226 | A1 | 5/2016 | Rado | |
| 2016/0174607 | A1 | 6/2016 | Montgomery | |

* cited by examiner

*Primary Examiner* — Edwin A. Leon
(74) *Attorney, Agent, or Firm* — Sheridan Ross P.C.

(57) ABSTRACT

A fluid cartridge for a vaporizer includes an inner tubular member and an outer tubular member with a space in between for holding a fluid to be vaporized. The inner tubular member includes a first connector for interconnecting with a second connector formed internal to a mouthpiece. The inner tubular member further includes a locking member that interconnects with at least one groove formed in an interior of the mouthpiece and the locking member and groove are configured to inhibit disconnection of the first and second connectors.

19 Claims, 9 Drawing Sheets

SELF-LOCKING CARTRIDGE

FIELD OF THE INVENTION

The present invention relates generally to personal vaporizers. More specifically, the present invention relates to methods and apparatus for restricting access to the contents of a cartridge that is used with a vaporizer.

BACKGROUND OF THE INVENTION

Vaporizer inhalation devices are increasing in popularity. They are considered by some a safer alternative to smoking using traditional methods. Generally, a vaporizer is a hand-held device that vaporizes a medium such as a liquid solution or a wax. The vapor is then inhaled by its user. A typical personal vaporizer has an atomizer having a heating element that selectively heats the medium in order to produce the vapor. A rechargeable battery is also typically employed for powering the atomizer. The battery is normally contained in a separate housing that is attachable to an oil or liquid containing cartridge. The cartridge containing the liquid media typically includes a fluid chamber or reservoir that holds the liquid, and a wick that communicates liquid from the chamber to the atomizer. The liquid solution typically includes chemicals such as one or more of propylene glycol, glycerin, polyethylene glycol 400, and an alcohol. Extracted flavorings can also be included in the fluid. Electronic cigarettes are a type of personal vaporizer, and use a liquid solution that includes tobacco-derived nicotine. Personal vaporizers also can be used with liquid solutions that include one or more of various essential oils, including herbal oil or *cannabis* oil.

Currently, disposable cartridges are available that include a liquid chamber and atomizer that are provided as a unit (sometimes referred to as a "cartomizer"). The cartridge can be attached to and detached from a separate battery housing for power. A mouthpiece may be integrally provided with a cartridge and sold as a single unit or the mouthpiece and cartridge may be separate components of a vaporizer where the mouthpiece and battery housing are reused.

Given the variety of chemicals that may comprise the liquid or oil within the cartridge, including tobacco or *cannabis* derived compounds, preventing unintended access to the liquid contents of a cartridge, for example by minors, is an important consideration in the design and construction of such cartridges. For at least this reason it is an aspect of the present disclosure to provide a cartridge that, once filled with a vaporizing liquid, may be locked such that access to the liquid is restricted other than by vaporizing the liquid.

SUMMARY OF THE INVENTION

According to aspects of the present disclosure, a cartridge for receiving a vaporizing liquid is provided and includes a locking mechanism for closing the cartridge once filled with liquid to inhibit direct access to the liquid. More particularly, a base is provided and configured to interconnect with a battery housing. An inner tubular member extends from the base in a direction opposite from the battery housing and comprises an atomizer and a passageway for communication with a mouthpiece. An outer tubular member surrounds the inner tubular member and forms a chamber or reservoir for holding a vaporizing medium, such as liquid or oil. A first connector is positioned at the end of the inner tubular member, opposite the base, to interconnect with a second connector. The second connector is associated with a cap or mouthpiece to hermetically enclose the liquid reservoir. A locking member is also associated with the cap or mouthpiece to inhibit removal of the cap or mouthpiece and thereby prevent access to the liquid once the cap or mouthpiece is in place. The locking member is configured for a single use meaning, once it is in place, it is difficult, if not impossible, to remove the cap or mouthpiece at least without damaging the component pieces.

According to aspects of the present disclosure, the locking member may be formed integrally with a cap or mouthpiece or it may comprise a sub-assembly configured to be assembled with the cap or mouthpiece. The locking member may comprise a locking bar that interfits within a slot formed in the inner tubular member and extends radially outward of the inner tubular member to engage a complimentary structure that is part of the cap, mouthpiece or sub-assembly. The complimentary structure may comprise a series of grooves or slots formed parallel with the longitudinal axis of the cartridge, and the locking bar may comprise one or more tabs that engage the grooves and are configured to permit interconnection of the cap or mouthpiece with the inner tubular member but not disconnection or separation of the cap or mouthpiece from the inner tubular member once the locking member and complementary structure are engaged.

The Summary of the Invention is neither intended nor should it be construed as being representative of the full extent and scope of the present invention. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention. Additional aspects of the present invention will become more readily apparent from the Detailed Description, particularly when taken together with the drawings.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, serve to explain the principles of these inventions.

It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

Figure 1:
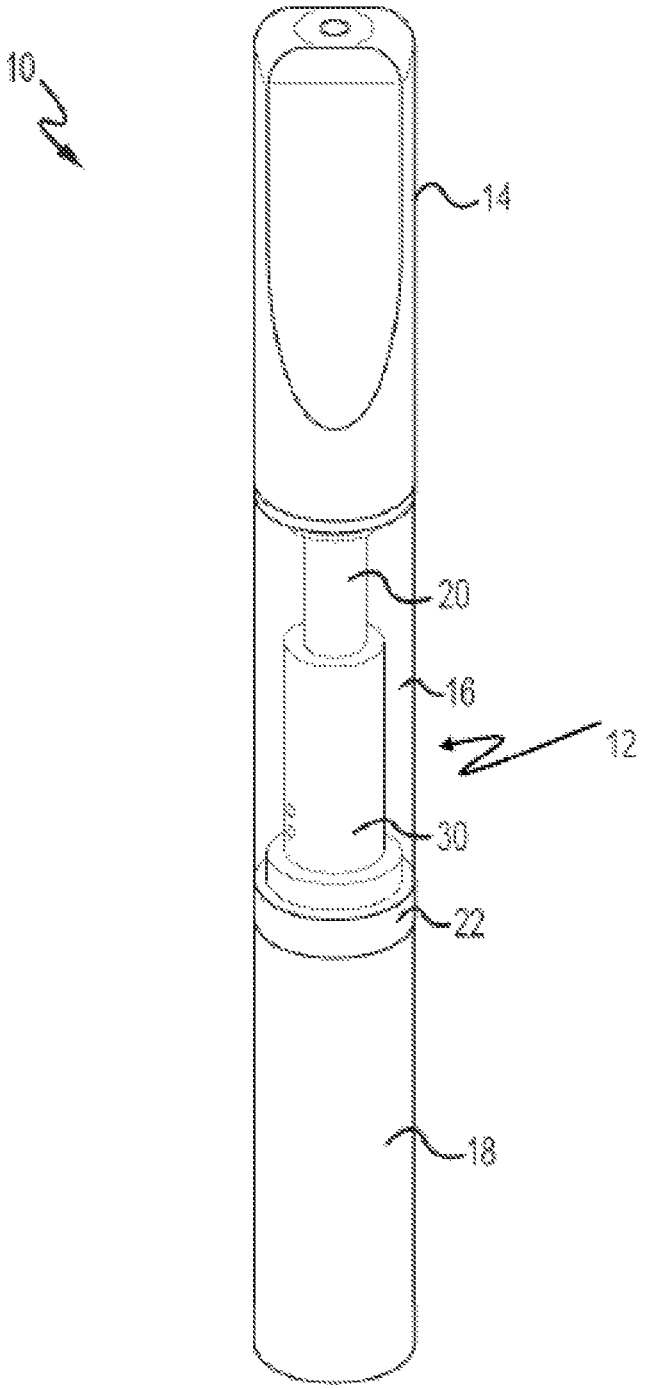
FIG. 1 is a perspective view of a vaporizer utilizing one embodiment of the cartridge of the present application.

FIG. 1 illustrates one embodiment of an electronic vaporizer 10 according to aspects of the present disclosure. The vaporizer comprises a cartridge 12 comprising a mouthpiece 14 and a fluid reservoir 16. The cartridge 12 is configured to interconnect to a housing 18 containing a battery (not shown). The battery is typically rechargeable and provides a source of power to an atomizer (not shown) positioned inside an inner tubular member 20 in fluid communication with the mouthpiece 14. The atomizer functions to vaporize a fluid contained within the fluid reservoir 16. In turn, the vapor is drawn through the inner tubular member 20 and mouthpiece 14 where it is inhaled by a user of the vaporizer 10.

Figure 2:
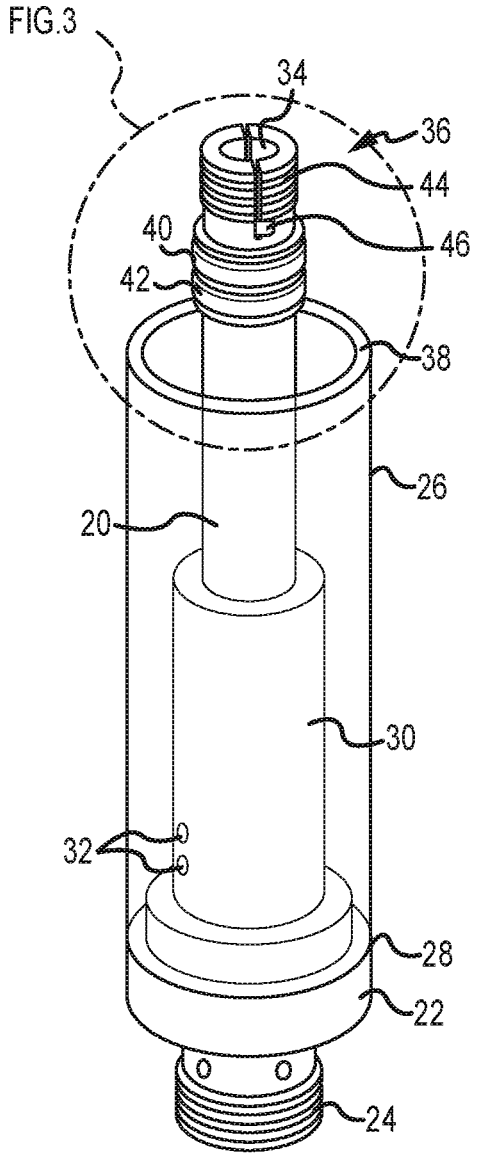
FIG. 2 is a perspective view of a cartridge with the mouthpiece removed according to aspects of the present application.

FIG. 2 is an illustration of an empty cartridge 12 and comprises a fluid reservoir 16 and atomizer 30 according to aspects of the present invention. A base 22 is configured with a male connector 24 for purposes of interconnecting with the battery housing 18. The inner tubular member 20 extends upwardly from the base 22. An outer tubular member 26 is spaced from and surrounds the inner tubular member 20. The space between the inner tubular member 20 and the outer tubular member 26 forms the fluid reservoir 16. A hermetic seal is formed between the distal end 28 of the outer tubular member 26 and the base 22 to prevent fluids exiting the distal end of the cartridge 12. According to aspects of the present disclosure, the outer tubular member may be made from glass or a similar material, or be made from metal or metal alloys. Preferably the outer tubular member 26 is transparent such that the volume of fluid in the reservoir is visible. The material from which the inner and outer tubular members 20 and 26 are constructed may depend upon the fluid or oil that is ultimately placed in the reservoir 16. The atomizer 30 is located inside the inner tubular member 20 and access holes 32 permit fluid within the reservoir to communicate with the atomizer 30. The inner tubular member 20 further includes an interior passageway 34 in communication with the atomizer 30.

Figure 3:
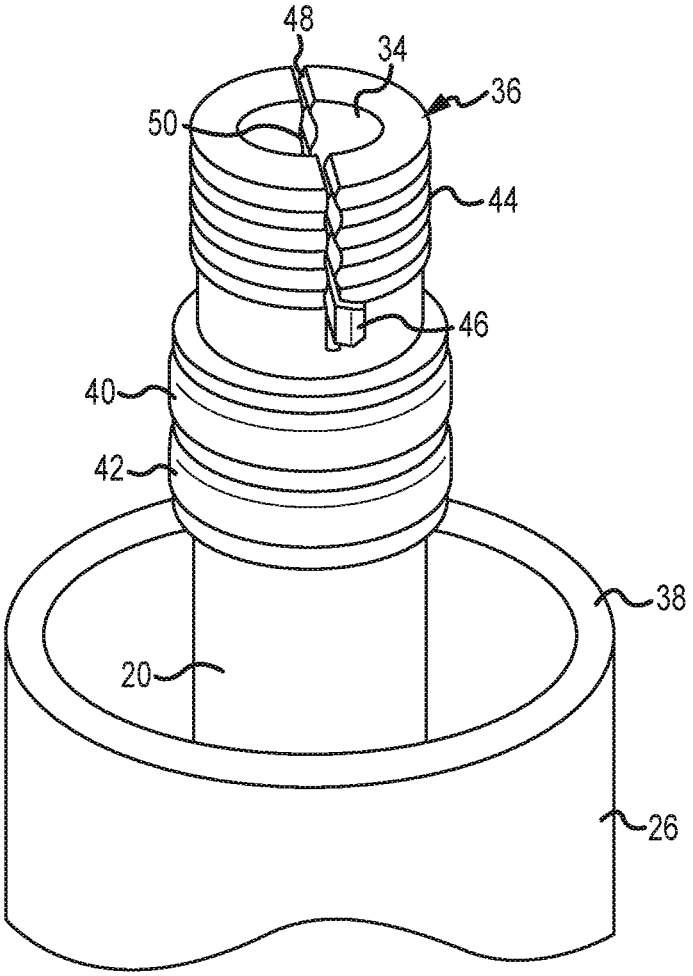
FIG. 3 is an enlarged perspective view of the proximal end of the inner and outer tubular members according to aspects of the present application.

With reference to FIGS. 2 and 3, the proximal end 36 of the inner tubular member 20 extends beyond the proximal end 38 of the outer tubular member 26. First and second O-rings or seals 40 and 42 are disposed around the inner tubular member 20. A first connector 44 is formed at the proximal end 36 of the inner tubular member 20. Here, the connector 44 is a threaded member. The threads may have a conventional winding or a reverse winding. A locking member 46 is associated with the proximal end 36 of the inner tubular member 20. According to aspects of the present disclosure, as shown in FIG. 3, the proximal end 36 of the inner tubular member 20 includes a slot 48 for purposes of receiving and holding the locking member 46. As illustrated in FIG. 3, side walls 50 of the slot 48 are non-linear for purposes of enhancing the ability of the slot 48 to retain the locking member 46.

Figure 4:
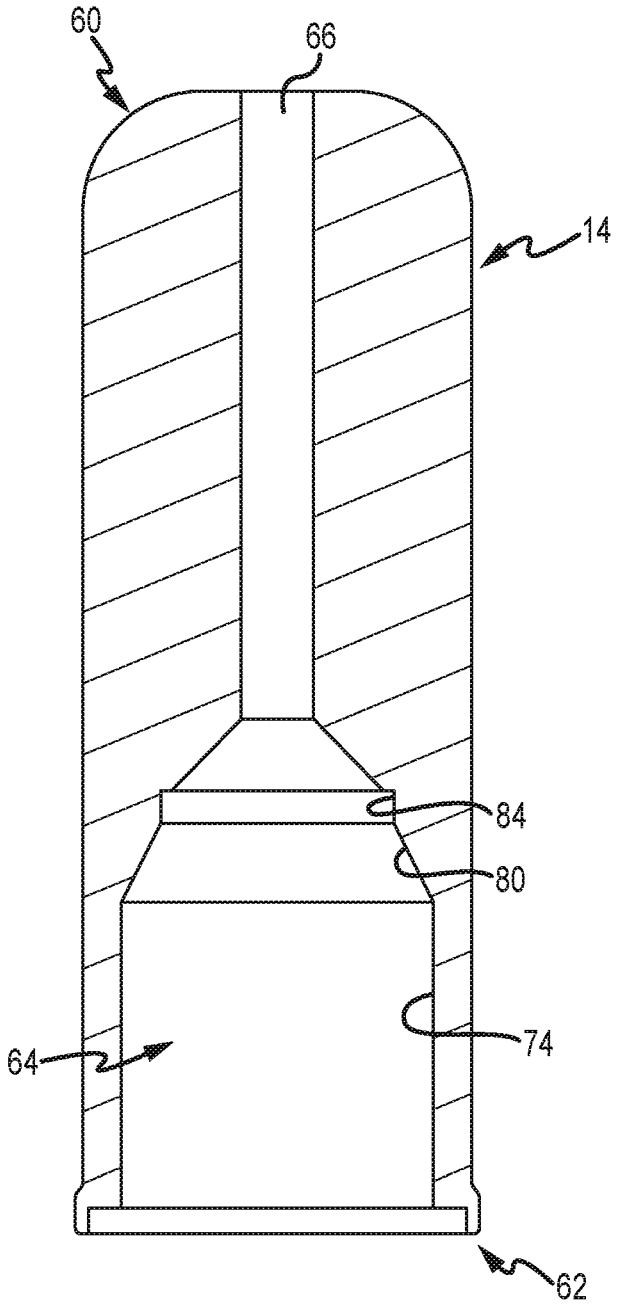
FIG. 4 is a cross-sectional plan view of a mouthpiece according to aspects of the present disclosure.

Turning to FIG. 4, one embodiment of a mouthpiece 14 is illustrated. The mouthpiece has a proximal end 60 and a distal end 62. An interior cavity 64 is formed at the distal end. A passageway 66 extends from the proximal end 60 to the internal cavity 64. According to aspects of the present disclosure, a first annular member 70 (illustrated in FIGS. 5A and 5B) and a second annular member 72 (illustrated in FIGS. 6A and 6B) are positioned in the internal cavity 64 of the mouthpiece 14 to provide structure for connecting the mouthpiece 14 to the fluid reservoir 16. It should be appreciated that the structure provided by the annular members 70 and 72 may alternatively be provided by a single annular member, a plurality of two or more annular members, or may be formed integrally in the side walls 74 of the internal cavity 64.

Figure 5A:
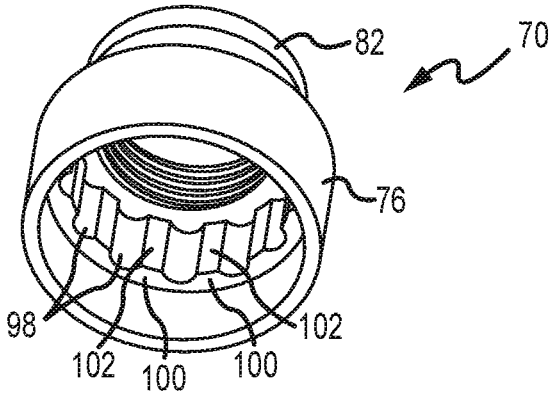
FIG. 5A is a perspective view of an annular insert for the mouthpiece according to aspects of the present invention.
Figure 5B:
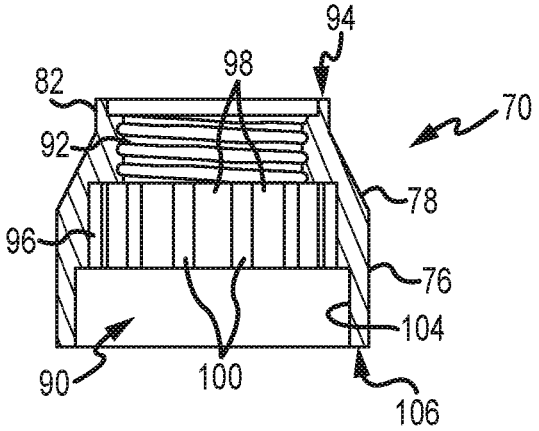
FIG. 5B is a cross-sectional view of the insert shown in FIG. 5A.

The annular member 70, as seen in FIGS. 5A and 5B, comprises a first portion 76 having an outer cylindrical configuration that matches the inner diameter of the internal cavity 64, a second portion 78 comprising a conical outer shape that matches section 80 of the internal cavity 64, and a third portion 82 having an outer cylindrical configuration that matches section 84 of the internal cavity 64. It is intended that the annular member 70 is press fit into the internal cavity 64, although surface features may be added to the exterior surface of the annular member to enhance engagement between the annular member 70 and the mouthpiece 14, for example, interlocking surfaces, screw threads, and the like.

The interior 90 of the annular member 70 has three components. A first section 92 located adjacent the proximal end 94 of the annular member 70 comprises a connector. As illustrated, the connector is a female threaded section configured to mate with the first connector 44 disposed at the proximal end of the inner tubular member 20. A second section 96 comprises a series of grooves 98 formed around the inner surface of the annular member 70. The grooves 98 are generally disposed parallel to the axial or longitudinal length of the vaporizer 10 and are separated by sections 100 having surfaces 102. The surfaces 102 are radially closer to the axial center line of the annular member 70 than are the surface of the grooves 98. A third section 104 formed at the distal end 106 of the interior 90 of the annular member 70 is configured to receive the annular member 72.

Figure 6A:
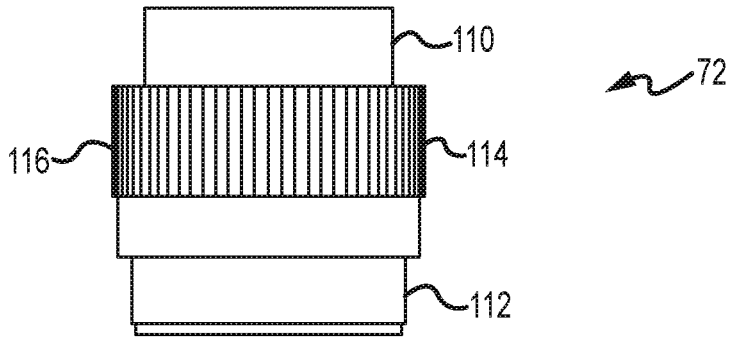
FIG. 6A is a plan view of a second insert for the mouthpiece according to aspects of the present application.
Figure 6B:
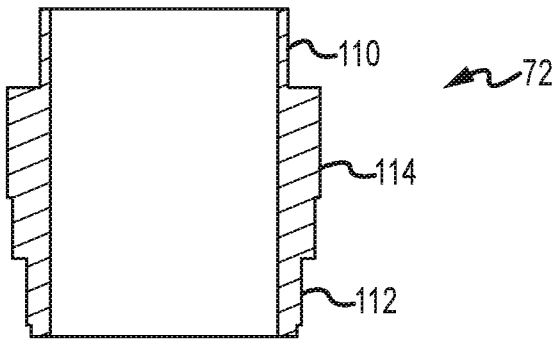
FIG. 6B is a cross-sectional view of the insert shown in FIG. 6A.

Annular member 72 is shown in more detail in FIGS. 6A and 6B. According to aspects of the present disclosure, annular member 72 has a proximal portion 110, a distal portion 112, and a central portion 114 disposed between the proximal portions 110 and the distal portion 112. The proximal portion 110 has an outer diameter that is less than the outer diameter of the central portion 114 and is configured to press fit into section 104 of annular member 70. The outer wall 116 of the central section 114 is provided with surface features, such as a knurled, roughened or grooved surface, to engage the inner surface 74 of the internal cavity 64 of mouthpiece 14 to provide a friction fit. It should be appreciated that other surface features different than illustrated may be utilized to enhance the friction fit or, alternatively, no enhanced surface feature may be utilized. The second annular member 72 acts to further secure the first annular member 70 in position within the internal cavity 64 of the mouthpiece 14.

Figure 7:
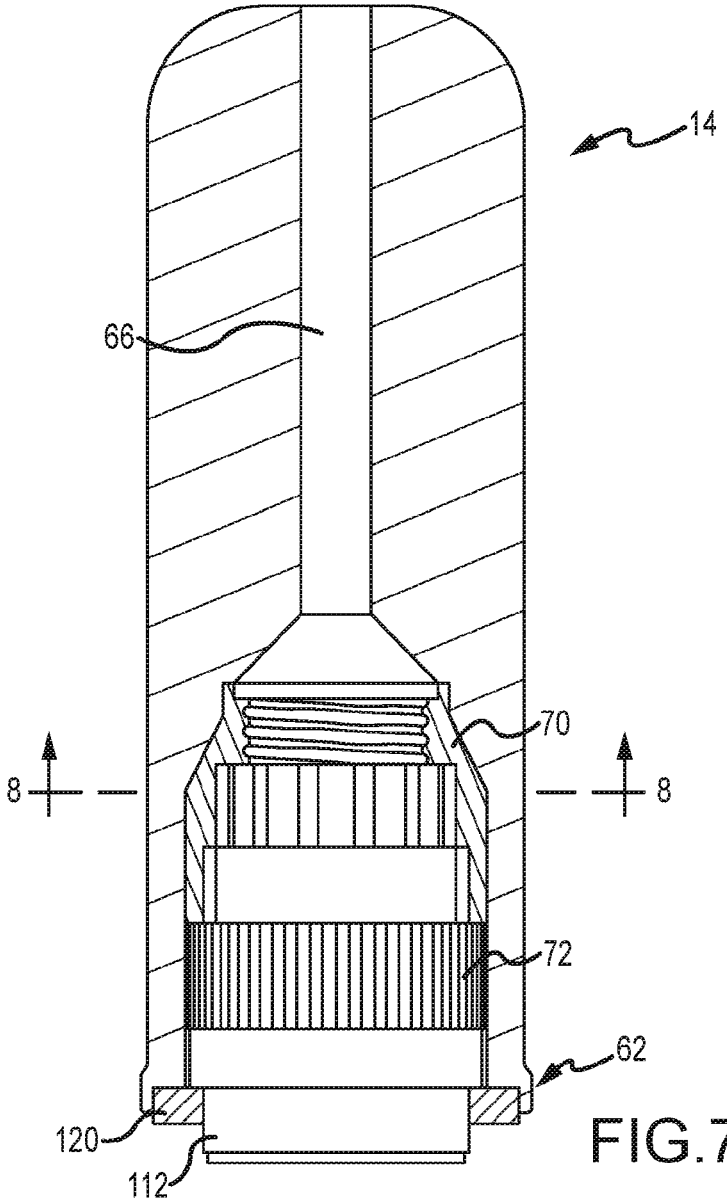
FIG. 7 is a partial cross-sectional view of the mouthpiece shown in FIG. 4 with the inserts of FIGS. 5A and 6A assembled in the mouthpiece.
Figure 8:
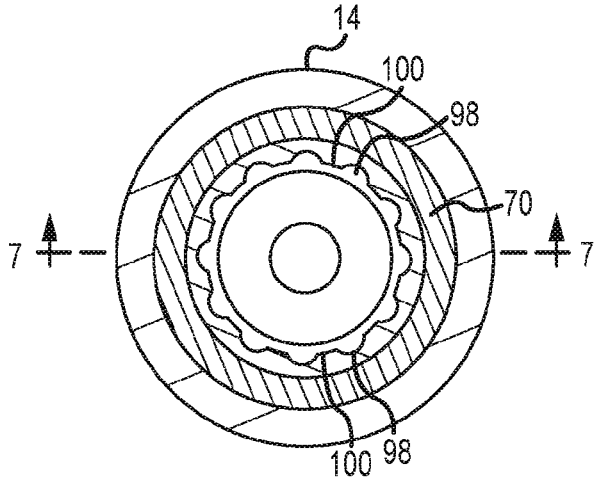
FIG. 8 is a top cross-sectional view taken along line 8-8 of FIG. 7.

FIG. 7 illustrates a mouthpiece subassembly where annular members 70 and 72 are positioned within the internal cavity 64 of the mouthpiece 14. A seal 120 is positioned at the distal end 62 of the mouthpiece 14 around section 112 of the second annular member 72 and is configured to nest against the proximal end 38 of the outer tubular member 26 to form a hermetic seal between the mouthpiece 14 and the outer tubular member 26. A cross-sectional view of the mouthpiece subassembly is shown in FIG. 8. FIG. 8 illustrates the orientation of the grooves 98 relative to surfaces 102. The surfaces 102 are radially closer to internal fluid passageway 66 than are the surfaces of the grooves 98. In this manner, sections 100 form teeth-like or ratchet-like structures around the inner surface of the annular member 70.

Figure 9:
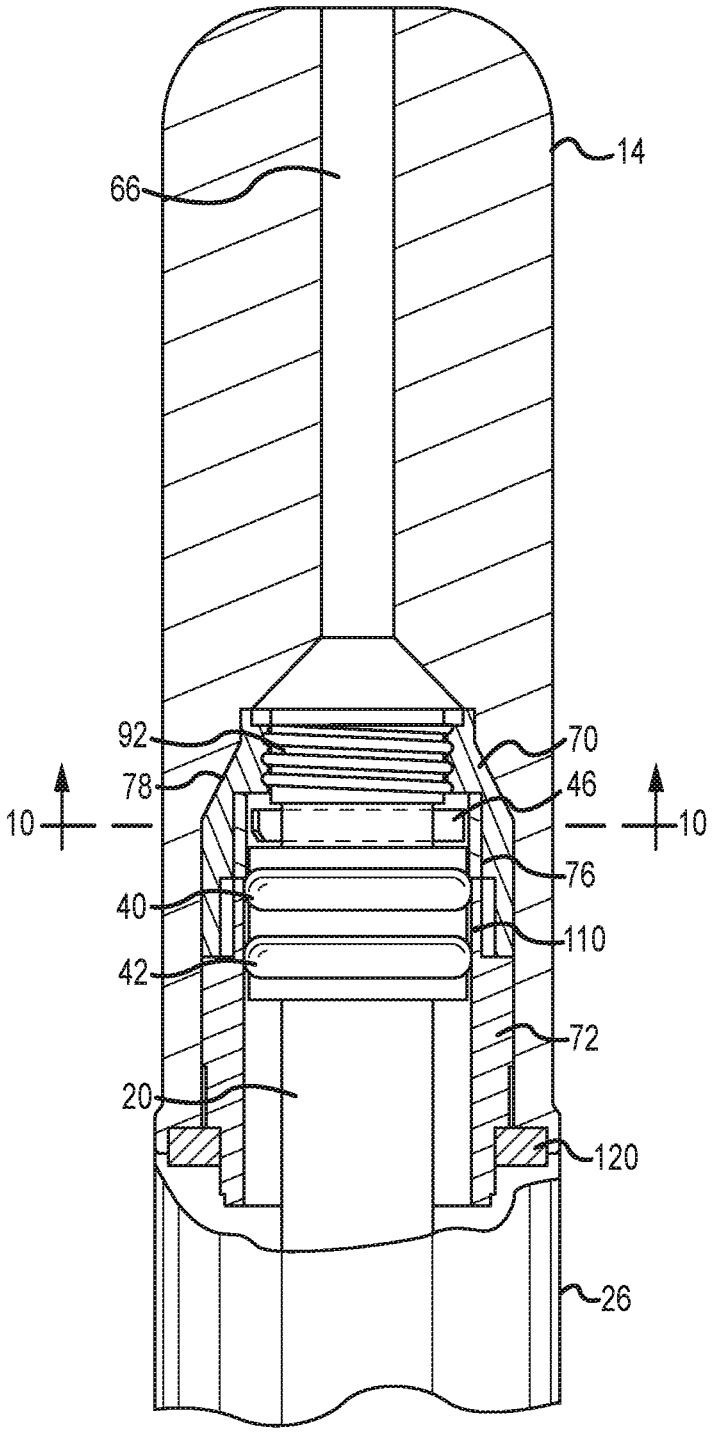
FIG. 9 is a partial cross-sectional view of an assembled cartridge according to aspects of the present disclosure.
Figure 10:
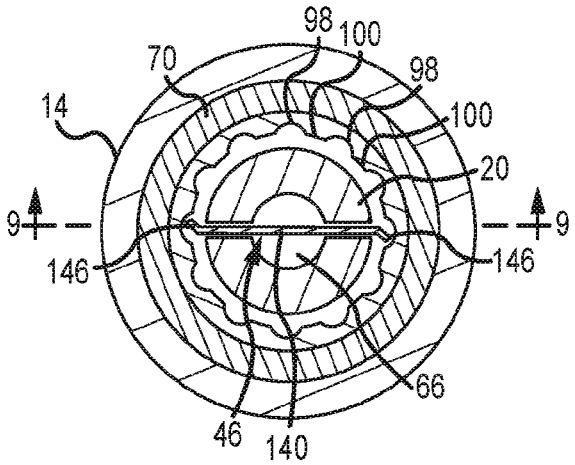
FIG. 10 is a top cross-sectional view taken along line 10-10 of FIG. 9.

A fully assembled cartridge 10 is illustrated in FIG. 9. A first connector 44 is threadably connected to a second connector 92. Seals 40 and 42 press against the inner wall 130 of the second annular member 72 to form a barrier between the fluid reservoir 16 and the passageway 66 of the mouthpiece 14. As better seen in FIG. 10, the locking member 46 interacts with the grooves 98 of the annular member 70. More particular, according to aspects of the present disclosure, the locking member 46 comprises a body portion 140 having a first end 142 and a second end 144 with a tab 146 disposed at each of the first end and second end 142 and 144. The tabs 146 are formed at an angle relative to the body portion 140. The purpose of the tabs 146 is to prevent disconnection of the first connector 44 from the second connector 92, while allowing the first connector 42 to be connected to the second connector 92. More specifically, the angular orientation of the tabs 146 is determined by the direction of the threaded connection between the first connector 44 and the second connector 92. The orientation illustrated in FIG. 10 is from the internal cavity 64 looking toward the proximal end 60 of mouthpiece 14. Accordingly, the locking member 140 will rotate counterclockwise as shown in FIG. 10 if the first connector 44 and second connector 92 have standard threads. The orientation of the tabs 146 allow for such counterclockwise rotation, as the tabs will deflect as the inner tubular member 20 rotates relative to the mouthpiece 14. Conversely, the angular orientation of the tabs 146 will inhibit, if not prevent, clockwise rotation of the locking member 140 relative to the grooves 98. Accordingly, once connected, the locking member 140 and the grooves 98 inhibit disconnection of the mouthpiece 14 relative to the fluid reservoir 16. In turn, direct access to the fluid reservoir 16 and any fluid contained therein is also inhibited.

Figure 11:
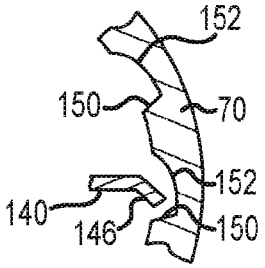
FIG. 11 is an enlarged view of a locking member according to aspects of the present disclosure.

FIG. 11 illustrates a groove 98 having a different configuration than as shown in FIG. 10. Rather than the uniform curvature of each groove 98 as shown in FIG. 10, FIG. 11 illustrates a groove 98 with a straight end wall 150 with a curved wall 152 forming the remainder of the groove 98. Here, the straight wall 150 inhibits a clockwise rotation of the locking member 140 relative to the grooves 98 where the threaded member would have threads oriented in a standard or conventional direction. The groove 98 would be oppositely shaped, with the position of the straight wall 150 and curved portion 152 reversed, if the connector 44 is reverse threaded. In the latter case, the tabs 146 would be angled in the opposite direction, for example by ninety degrees in the counterclockwise direction with reference to FIG. 11.

Figure 12:
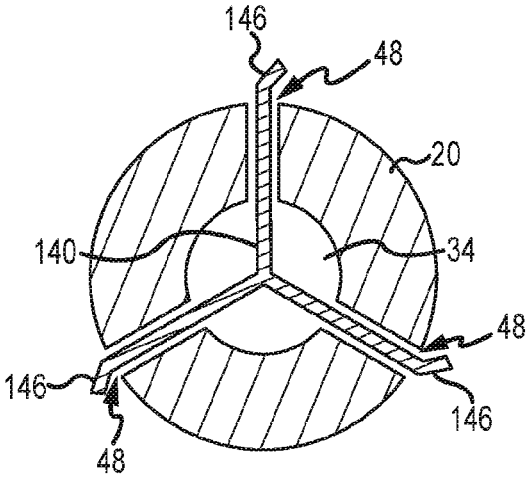
FIG. 12 is an alternative view of a locking member according to aspects of the present disclosure.
Figure 13:
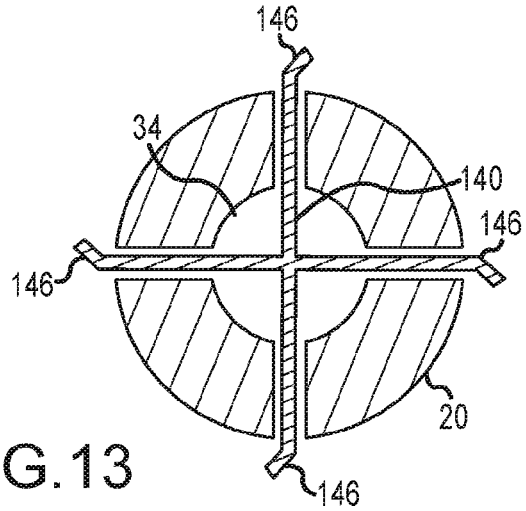
FIG. 13 is an alternative view of a locking member according to aspects of the present disclosure.

FIGS. 12 and 13 illustrate different embodiments of the locking member 140 according to aspects of the present disclosure.

As another alternative, rather than extending beyond the proximal end 38 of the outer tubular member 26, the proximal end 36 of the inner tubular member 20 may terminate at a location inside the outer tubular member 26. In this configuration, the mouthpiece 14 and/or annular members 70 and 72 are reconfigured such that the first connector 44 at the proximal end 36 of the inner tubular member 20 may be interconnected with a complementary connector associated with the mouthpiece 14. For example, the annular members 70 and 72 may be reconfigured as a single annular member to extend distally beyond the distal end 62 of the mouthpiece to engage the first connector 44. The seal 120 will still create a fluid tight seal between the distal end 62 of the mouthpiece 14 and the proximal end 38 of the outer tubular member 26. It is also an aspect of the present disclosure that the first connector 44 may comprise a female threaded member and one of the annular members 70 and 72 comprise a male threaded member while maintaining the ability to lock the mouthpiece 14 relative to the cartridge 12 as would be appreciated by those of skill in the art upon review of the present disclosure.

While various embodiments of the disclosed device have been described in detail, it is apparent that modifications and alterations of those embodiments will occur to those skilled in the art. However, it is to be expressly understood that such modifications and alterations are within the scope and spirit of the present invention, as set forth in the following claims. Further, the invention(s) described herein are capable of other embodiments and of being practiced or of being carried out in various ways. In addition, it is to be understood that the phraseology and terminology used herein is for the purposes of description and should not be regarded as limiting. The use of "including," "comprising," or "adding" and variations thereof herein are meant to encompass the items listed thereafter and equivalents thereof, as well as, additional items.

The foregoing discussion of the invention has been presented for purposes of illustration and description. The foregoing is not intended to limit the invention to the form or forms disclosed herein. In the foregoing description for example, various features of the invention have been identified. It should be appreciated that these features may be combined together into a single embodiment or in various other combinations as appropriate. The dimensions of the component pieces may also vary, yet still be within the scope of the invention. Moreover, though the description of the invention has included description of one or more embodiments and certain variations and modifications, other variations and modifications are within the scope of the invention, e.g. as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

The present invention, in various embodiments, includes components, methods, processes, systems and/or apparatus substantially as depicted and described herein, including various embodiments, subcombinations, and subsets thereof. Those of skill in the art will understand how to make and use the present invention after understanding the present disclosure. The present invention, in various embodiments, includes providing devices and processes in the absence of items not depicted and/or described herein or in various embodiments hereof, including in the absence of such items as may have been used in previous devices or processes, e.g., for improving performance, achieving ease and/or reducing cost of implementation. Rather, as the following claims reflect, inventive aspects lie in less than all features of any single foregoing disclosed embodiment. Thus, the following claims are hereby incorporated into this Detailed Description, with each claim standing on its own as a separate preferred embodiment of the invention.

What is claimed is:

1. A fluid cartridge for a vaporizer, comprising:

a. an outer tubular member having a proximal and distal end;

b. an inner tubular member having a proximal and distal end, the inner tubular member disposed inside the outer tubular member, having a first internal fluid passageway and a first connector disposed at the proximal end of the inner tubular member;

c. a locking member disposed at the proximal end of the inner tubular member and having a first end extending radially outwardly beyond an exterior surface of the inner tubular member;

d. a base disposed at the distal end of the inner tubular member and configured to engage the distal end of the outer tubular member;

e. a mouthpiece having a proximal end and a distal end, an internal cavity formed at the distal end, a second internal fluid passageway extending from the internal cavity to the proximal end, a second connector disposed in the internal cavity and configured to mate with the first connector; and f. a plurality of grooves disposed at the perimeter of the internal cavity, wherein one or both of the first end of the locking member and grooves are configured to permit interconnection of the first and second connectors and to inhibit disconnection of the first and second connectors.

2. The fluid cartridge of claim 1, wherein the locking member comprises a lock bar having a body portion with a first end and a second end, and at least a first tab disposed at the first end, and wherein the first tab sequentially engages consecutive grooves as the first and second connectors are joined.

3. The fluid cartridge of claim 1, wherein the locking member comprises a lock bar having a body portion with a first end and a second end, a first tab disposed at the first end at an angle relative to the body portion, and a second tab disposed at the second end at an angle relative to the body portion, and wherein the first and second tabs engage consecutive grooves when the first connector is rotated in a first direction relative to the second connector, and wherein the first and second tabs inhibit rotation of the first connector relative to the second connector in a direction opposite to the first direction.

4. The fluid cartridge of claim 2, further comprising a second tab extending from the second end of the body of the lock bar and wherein the second tab sequentially engages consecutive grooves as the first and second connectors are joined.

5. The fluid cartridge of claim 1, wherein the proximal end of the inner tubular member comprises a slot configured to hold the body portion of the lock member.

6. The fluid cartridge of claim 2, wherein the at least a first tab is oriented at an angle relative to the body portion of the locking member.

7. The fluid cartridge of claim 1, wherein the first connector is one of a male or female threaded member and the second connector is the other of a male or female threaded member.

8. The fluid cartridge of claim 1, further comprising a first bushing having a proximal end and a distal end, and exterior surface and an interior surface, the exterior surface configured to engage the surface of the internal cavity of the mouthpiece, and wherein the second connector and the plurality of grooves are disposed on the interior surface of the bushing.

9. The fluid cartridge of claim 1, wherein the locking member comprises a body portion having a plurality of ends and at least one tab extending from one end.

10. The fluid cartridge of claim 9, wherein the locking tab comprises a body portion having at least two ends and a tab extending from each end.

11. The fluid cartridge of claim 1, wherein a groove comprises a curved surface.

12. The fluid cartridge of claim 1, wherein a groove comprises a first flat surface and a second surface.

13. A fluid cartridge for a vaporizer, comprising:

a. a tubular outer member having a first end and a second end;

b. a base in sealing engagement with the second end of the tubular outer member, and configured to interconnect with a battery housing;

c. a tubular inner member extending from the base through the interior of the tubular outer member and terminating at a distal end;

d. a first threaded connector disposed at the distal end of the tubular inner member;

e. a locking member disposed at the distal end of the tubular inner member and comprising at least one tab extending outwardly beyond the surface of the tubular inner member;

f. a mouthpiece having a first end and a second end, an interior cavity disposed at the second end of the mouth piece and a fluid passageway extending from the interior cavity to the first end of the mouthpiece, a second threaded connector configured to mate with the first threaded connector and disposed in the interior cavity, and a plurality of grooves disposed around the perimeter of the interior cavity, the plurality of grooves configured to engage the at least one tab;

g. wherein interconnecting the first and second threaded connectors creates a sealing engagement between the second end of the mouthpiece and the first end of the tubular outer member, and also creates an engagement between the at least one tab and a groove.

14. The fluid cartridge of claim 13, wherein the first end and second end of the tubular outer member defines and axis, and wherein the grooves are axially oriented.

15. The fluid cartridge of claim 13, wherein the first connector comprises a male threaded member and the second connector comprises a female threaded member.

16. The fluid cartridge of claim 13, further comprising a slot formed in the distal end of the tubular inner member, and wherein the locking member is removably positioned in the slot.

17. The fluid cartridge of claim 13, further comprising an atomizer disposed within the tubular inner member.

18. The fluid container of claim 13, wherein the distal end of the tubular inner member extends beyond the distal end of the tubular outer member.

19. A method for locking a vaporizer mouthpiece to an oil container, comprising:

a. providing a mouthpiece having an internal cavity, a first connector disposed within the inner cavity, and a plurality of grooves formed on the perimeter surface of the internal cavity;

b. providing an oil container comprising an outer tubular member and an inner tubular member, wherein the inner tubular member comprises a second connector configured to interconnect with the first connector;

c. providing a locking member extending outwardly from the inner tubular member proximate the second connector;

d. interconnecting the first and second connectors to form a seal between the oil container and the mouthpiece, and causing the locking member to engage at least one groove and wherein the engagement prevents the locking member from disengaging the groove.

* * * * *